US005461012A

United States Patent [19]

MacMillan et al.

[11] Patent Number: 5,461,012

[45] Date of Patent: Oct. 24, 1995

[54] NON-EXPLOSIVE FINE METALLIC POWDER MIXTURES FOR MAKING REFRACTORIES

[75] Inventors: John P. MacMillan; Martin J. Bray, both of Renfrew; Douglas J. Zuliani, Stittsville, all of Canada

[73] Assignee: Timminco Ltd., Toronto, Canada

[21] Appl. No.: 254,110

[22] Filed: Jun. 6, 1994

Related U.S. Application Data

[63] Continuation-in-part of Ser. No. 13,347, Feb. 4, 1993, Pat. No. 5,338,712.

[51] Int. Cl.[6] ..... C22C 29/00

[52] U.S. Cl. ..... 501/94; 75/243; 75/354; 149/110; 501/108; 501/113; 501/127; 501/133

[58] Field of Search ..... 75/252, 232, 233, 75/234, 235, 249, 354, 243; 501/94, 100, 108, 127, 133, 153, 43, 105, 101, 113, 118, 121, 128; 149/110, 124; 428/559, 560

[56] References Cited

U.S. PATENT DOCUMENTS

| | | |
|---|---|---|
| 3,322,551 | 5/1967 | Bowman . |
| 3,890,166 | 6/1975 | Kondis . |
| 4,069,060 | 1/1978 | Hayashi et al. . |
| 4,078,599 | 3/1978 | Makiguchi et al. . |
| 4,222,782 | 9/1980 | Alliegro . |
| 4,243,621 | 1/1981 | Mori et al. . |
| 4,280,844 | 7/1981 | Shikano et al. . |
| 4,306,030 | 12/1981 | Watanabe et al. . |
| 4,460,528 | 7/1984 | Petrak et al. . |
| 4,557,884 | 12/1985 | Petrak et al. . |
| 4,588,442 | 5/1986 | Richmond et al. . |

FOREIGN PATENT DOCUMENTS

| | | |
|---|---|---|
| 2209345 | 5/1989 | United Kingdom . |

OTHER PUBLICATIONS

U.S. Dept. of the Interior: Bureau of Mines, Oct. 1943 Report of Investigations, "Inflammability and Explosibility of Metal Powders" by Irving Hartmann, John Nagy and Hylton R. Brown. (pp. 27–28).

Database WPI. Derwent Publications Ltd., London, GB, AN80–03355c & SU A, 659,601 (Alum Magn electr Ind) 29 May 1979. See abstract.

Patent Abstracts of Japan, vol. 12 No. 332 (M–738) Sep. 1988, & JP S,63 096 201 (Kurosaki Refract. Co. Ltd), 27 Apr. 1988.

*Primary Examiner*—Mark L. Bell
*Assistant Examiner*—Paul Marcantoni
*Attorney, Agent, or Firm*—Nixon & Vanderhye

[57] ABSTRACT

A substantially non-explosive mixed powder containing finely divided metallic particles suitable for being incorporated in a refractory mixture, intimately mixed together with inert refractory particles. The refractory particles are present in such particle sizes and quantities as ensure that the Minimum Explosible Concentration, as tested in a 20-L vessel with a chemical igniter, is greater than 100 gm/m$^3$. The inert particles comprise at least 40% of the mixture, and preferably 50% to 80%. The invention also includes a premixed powder, of the metallic and refractory powder, especially as contained in a shipping container in drums or impermeable bags. Due to the presence of the refractory powder, the mixed powder can be shipped without the precautions usually needed for shipping finely divided metal powders.

11 Claims, 2 Drawing Sheets

NON-EXPLOSIVE FINE METALLIC POWDER MIXTURES FOR MAKING REFRACTORIES

RELATED APPLICATIONS

This application is a continuation-in-part of application Ser. No. 08/013,347, filed Feb. 4, 1993, now U.S. Pat. No. 5,338,712.

FIELD OF THE INVENTION

BACKGROUND OF THE INVENTION

This invention relates to non-explosive mixtures of fine metallic powders and inert refractory powder for use as a raw material component in the production of high temperature refractories.

PRIOR ART

In recent years, it has become the practice for certain refractory materials, especially those used for lining molten metal containers, to be formed from a mixture containing particles of aluminum or magnesium metal and/or alloys thereof, in addition to the usual refractory powders and binders. Calcium alloys have also been suggested for this purpose. The metal particles react during firing of the refractory mixture to form oxides or other compounds. Examples of processes for making refractories using such metal particles arc given in the following patents:

U.S. Patent No. 3,322,551 (Bowman)

U.S. Pat. No. 4,069,060 (Hayashi et al.)

U.S. Pat. No. 4,078,599 (Makiguchi et al.)

U.S. Pat. No. 4,222,782 (Alliegro)

U.S. Pat. No. 4,243,621 (Mori et al.)

U.S. Pat. No. 4,280,844 (Shikano et al.)

U.S. Pat. No. 4,460,528 (Petrak et al.)

U.S. Pat. No. 4,306,030 (Watanabe et al.)

U.S. Pat. No. 4,460,528 (Petrak et al.)

U.S. Pat. No. 4,557,884 (Petrak et al.)

In making the refractories by the methods described in the aforesaid patents, it is generally considered advantageous to use very fine metallic particles. U.S. Pat. No. 4,078,599 suggests that a suitable particle size for the aluminum powder is smaller than 200 mesh (74 microns), whereas U.S. Pat. No. 4,222,782 suggests particle sizes of 4.5 microns and 4.0 microns which is smaller than 400 mesh. This has led to a demand for metal producers to sell metallic powders having very small particle sizes of this order. However, very fine metallic powders pose an explosion hazard, since they are subject to dusting in which situation an explosion can easily occur if there is a spark or some ignition source. This makes it difficult to produce, package, ship and handle such fine metallic powders while ensuring safety from explosions and fires.

While finely distributed metallic powders as described above are desirable, many metal powder producers and refractory manufacturers choose not to produce or use such fine powders because of the related explosion hazards. For this reason, many refractory manufacturers sacrifice refractory performance for safety by using substantially coarser metallic powders which may contain up to 50% of the fraction between 35 mesh and 100 mesh (from 420 to 150 microns). The object of the present invention is to supply finely divided metallic powders with a particle size distribution that provides optimum performance in the final refractory product with substantially reduced explosivity risk during production, packaging, shipping, handling and storage of said metallic powders.

SUMMARY OF THE INVENTION

In accordance with one aspect of the present invention, finely divided metallic powders such as but not exclusively aluminum, magnesium or alloys of aluminum, magnesium or calcium, are blended with inert material to render them relatively or substantially non-explosive as compared to the unblended metallic powders. The term "inert" as used herein means non-combustible. The preferred inert materials are refractory materials that can be usefully incorporated into the final refractory product such as, but not necessarily, calcined dolomite, burnt magnesite and/or alumina. It has been found that premixed powders of this type can be safely stored, packaged, transported and handled without serious risk of explosion or fire and hence are suitable for safe use by refractory manufacturers. The amount of inert material which needs to be included is often very much less than is required in the final refractory product.

The finely divided metallic powder and the inert material may be produced simultaneously by grinding together larger pieces of the metal or alloy and inert material. In this way, the finely divided metal powders are never without an admixture of inert material, and thus reduce the explosion hazard during their production. Grinding may also be conducted under inert gas such as argon or nitrogen to further reduce the risk of explosion.

The simultaneous grinding of metals or alloys and inert material is functional when the metallic constituent is sufficiently brittle to be ground by conventional comminution technology such as in a ball mill, rod mill, hammer mill, hogging mill, pulverizing mill or the like. In these cases, the metallic portion of the feedstock to the grinding mill is blended with the correct proportion of the inert material for simultaneous grinding to the desired screen size distribution of the final metallic blended powder. The metallic feed to the grinding mill may be in the form of pieces such as ingots, chunks, granules, machined turnings or chips and the like which may be produced by a preliminary casting, crushing or machining process. Because of their coarser size distribution, these metallic feed materials are considerably less explosive and much safer to handle than the finely divided metallic powders required for refractory applications. The inert material feed may also be in the form of pieces such as briquettes or granules larger than the final particle size; or may be preground powder suitable for refractory manufacture. Simultaneous grinding as described above can best be applied to the production of finely divided magnesium-aluminum alloys, magnesium-calcium alloys, calcium-aluminum alloys and the like. This simultaneous grinding produces a ground mixture which serves as a premixture for making refractories; at this stage the premixture of course does not have any binder.

For metals or alloys which are not sufficiently brittle for grinding, finely divided metallic powders can be produced directly from liquid metals and alloys by an atomization process. Blending of the atomized metal powders with the correct proportion of inert material renders the mixture substantially non-explosive and hence safe for subsequent processing, packaging, shipping, handling and storage. Examples of this would be blending of inert materials with atomized aluminum metal, magnesium metal and the like. In cases where the metallic powder is produced separately from production of inert material it can if necessary be inhibited from explosion by the use of inert gas, until mixed with the inert refractory powder.

The explosivity of the premixture in accordance with this invention depends on the fineness of both the metallic powder and the inert material, and on the amount of inert material in the premixture. The amount and sizing of the inert material may be chosen to make the premixture entirely non-explosive in air. Alternatively, the inert material may just be enough to ensure that the premixture of fine metallic powder and inert material is at least as non-explosive as coarse metallic powders presently marketed for refractory mixes without explosion safeguards, such as metallic powders having say 30% of −100 mesh particles. As will be explained more fully below, a suitable standard would be that the Minimum Explosible Concentration (MEC), as tested in a 20-L vessel with a chemical igniter, should be greater than 100 $gm/m^3$. Depending on the fineness of the metallic particles and the inert particles, this result may be achieved with only about 40% or 50% of the premixture comprising the inert material. Preferably however, sufficient inert material should be used to ensure that the MEC is greater than 200 $gm/m^3$.

However, it may be desirable to make the premixture effectively nonexplosive, for which purpose the inert material should have a screen size which is 80% −100 mesh or smaller, and should be present in a proportion of at least 70% or 75%. A high proportion of inert refractory material adds to shipping costs; so the maximum that will likely be used is about 80%.

All references to percentage compositions herein are by weight.

Although, prior to this invention, fine metallic powders have been mixed, in small amounts, with refractory powders as a part of the process for making refractories, it is not believed that any such mixtures have been packaged for sale or transport. Accordingly, a further novel aspect of this invention is a novel combination comprising a shipping container and, contained therein, a premixture of finely divided metallic powder and finely divided inert refractory material suitable for use in making a refractory, the amount and fineness of the inert material being sufficient to render the premixture substantially non-explosive and, at least, safe for normal shipping and handling. The premixture is provided without any binder and is in dry and flowable form. Suitable shipping containers include metal or fiber drums, preferably having plastic liners, so-called "tote bins", made of steel and so-called "supersacks" which are large bags woven of synthetic material, and having an impervious (e.g. plastic) liners. Strong paper bags may also be used. The packaging for the premixture has to be designed to avoid hydralion, but prevention of explosion is not a consideration. By contrast, fine metal powders now have to be shipped in steel drums, by regulations, in view of the explosion hazard.

BRIEF DESCRIPTION OF THE DRAWINGS

The invention will be described with reference to the following drawings, in which.

DETAILED DESCRIPTION

Figure 1:
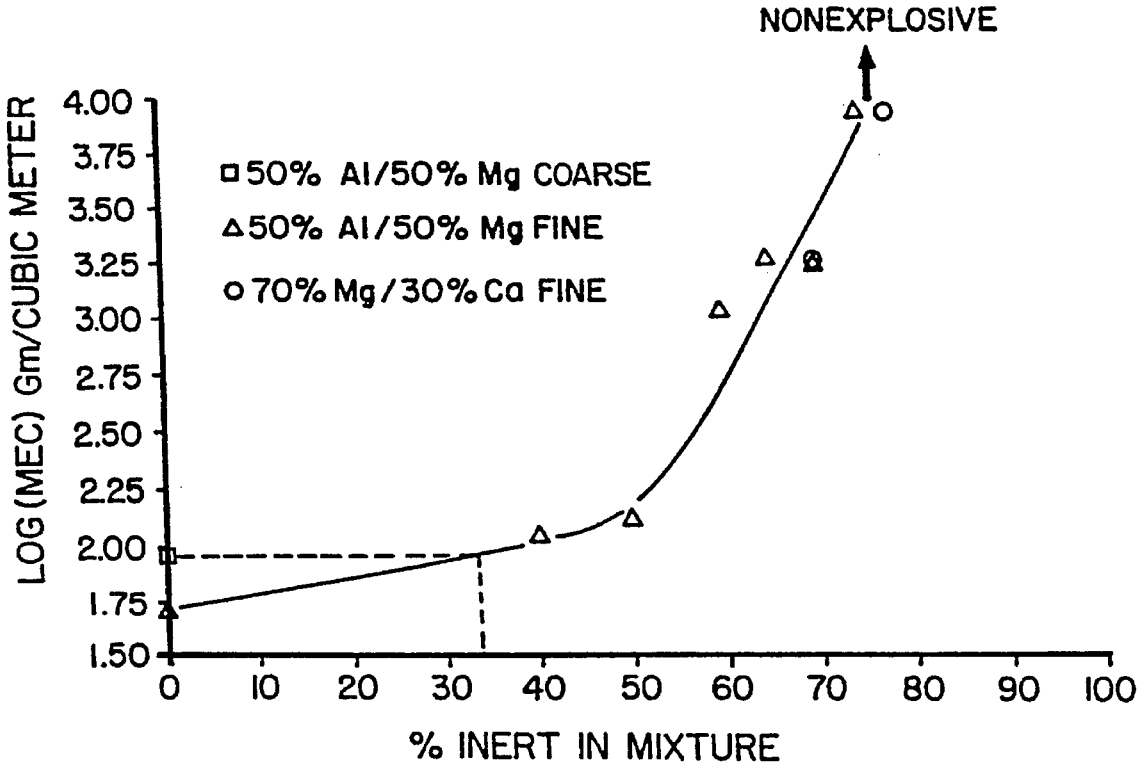
FIG. 1 is a graph showing the logarithm of the MEC (Minimum Explosible Concentration) against percentage inert material in the premixture.

A preferred process for preparing a raw material for refractory production will now be described.

The metallic portion of the raw material product can be in the form of ingots and the like or partially comminuted chunks, granules, chips, turnings and the like obtained by suitable crushing or machining processes known to people skilled in the art. For grinding, the material will normally be an alloy.

The metallic portion is charged to a suitable grinding mill in combination with the desired proportion of inert material. The inert material is preferably a refractory type material, and may be oxides or a blend of oxides which are compatible with the final refractory product, for example, calcined or burnt magnesite which consists principally of magnesia (MgO), calcined dolomite which consists principally of a chemical blend of lime (CaO) and magnesia (MgO), calcined bauxite, alumina ($Al_2O_3$), which consists principally of aluminum oxide, silica ($SiO_2$), and other such suitable oxides. The inert materials may contain impurities which are acceptable to the final refractory product such as lime (CaO) and silica ($SiO_2$). These inert materials may be in the form of chunks, briquettes, pieces, preground fines and the like.

The blended metallic and inert materials are simultaneously and progressively reduced in size in a suitable milling device such as a ball mill, rod mill, hammer mill, hogging mill, pulverizing mill and the like. The grinding should be such as to reduce the particle size of the majority (at least 50%) of the metallic alloy to less than 35 mesh (400 microns) and preferably less than about 100 mesh (150 microns). The particle size of the inert material should preferably be such that a majority (i.e. at least 50%) is less than 65 mesh; if the premixture contains 75% of inert particles of −65 mesh it will be substantially non-explosive. Preferably, at least 50% of the inert material particles are less than 100 mesh. It is also important to adjust the particle size of the inert material so that it is fine enough to substantially reduce the explosivity of the mixture and is compatible with the size distribution requirements of the refractory blend mixture. However, very fine refractory particles are not required and usually a significant proportion, such as 25%, or 30%, or 40%, will be larger than 200 mesh or 74 microns. This can be accomplished in the present invention by adjusting the size distribution of the inert material charged to the mill and the length of grinding time. In cases where added protection from explosion is required, grinding may be conducted under an inert gas shroud such as argon or nitrogen.

As indicated above, for metals not suitable for grinding, fine powder produced by atomization can be mixed with inert powder, using appropriate safety measures.

The proportion of inert oxide in the mixture is more than about 40%, preferably more than 50%, and most desirably more than about 60%. It is chosen to be such that, at a minimum, the mixture of fine metallic powder and inert material is not more explosive than the pure unblended metallic powder typically used for many refractory applications and hence refractory manufacturers obtain the benefits of fine metallic powder in a substantially safer form, or can use finer powder than that previously used without precautions. The explosiveness of a mixture of metallic powder and inert material depends on both their relative proportions in the mixture and their respective fineness; criteria for choosing the proper proportions and fineness of materials are discussed below and supported by appropriate examples.

Since the premixed fine metallic and inert refractory powders can be made substantially non-explosive, they can be handled, packaged and shipped to the point at which the refractory is to be made without taking precautions against explosions. When received by the refractory maker, the premixed metallic and inert oxide powders are mixed in with other refractory materials, as necessary, and with binders, and can be formed into refractories in the usual way.

The patents listed above give some examples of how metallic powders and burnt magnesite can be used for making refractories.

For example, U.S. Pat. No. 3,322,551 describes a process in which finely divided aluminum or magnesium is incorporated into a refractory mix containing basic or non-acid calcined (burnt) oxide refractory grains such as periclase, magnesite, chromite, dolomite and the like, bonded together by cokeable, carbonaceous bonding agents such as tar or pitch. Such refractories are widely used as linings for basic oxygen steel converters.

This '551 patent suggest the following mixture (as specimen A-2) for making refractory bricks:

71 parts by weight of deadburned magnesite, comprising 81% MgO, 12% CaO, 5% $SiO_2$, balance impurities;

24.8 parts of periclase having over 98% MgO;

3.5 parts of pulverized pitch having a softening point of 300°–320° F.;

1.2 parts neutral oil (a light oil from which all the naphthalene has been removed); and 1 part by weight magnesium powder of less than 100 mesh size.

If it were desired to make a similar composition using the non-explosive powder mixture of this invention, and having 25 % magnesium metal powder mixed with 75% of deadburned magnesite, the mixture could be as follows:

68 parts of deadburned magnesite;

24 parts of periclase;

3.5 parts of pulverized pitch;

1.2 parts neutral oil; and 4 parts of the non-explosive mixture containing 1 part of magnesium and 3 parts of burned magnesite.

It would of course be theoretically possible to provide the metallic powder premixed with all of the inert refractory material, i.e. all of the deadburned magnesite and periclase. However, this would give a mixture containing well over 95% of inert refractory material, and it would not normally be practical or economical to have all of this material transported from the metal producer. It is desirable from the point of view of economics that the refractory or inert particles are not more than 90% of the total mixture, and they will normally be less than 80% of the total. Hereinafter there are set out criteria for determining what proportion of inert material needs to be included in the mixture to ensure that this is wholly or relatively non-explosive.

U.S. Pat. No. 3,322,551 also sets out mixtures which can be used for making refractories and which contain pulverized aluminum. In fact, a refractory can be made using the same proportions as set out above, except for using aluminum or aluminum-magnesium alloys in place of magnesium. Many of the other patents listed above give examples of refractory mixtures which can be used containing aluminum, and in which the inert refractory material is alumina. These include U.S. Pat. Nos. 4,078,599, 4,222,782 and 4,243,621. U.S. Pat. Nos. 4,460,528 and 4,557,884 are concerned with refractory compositions including aluminum metal and silica; accordingly a non-explosive mixture of aluminum metals and alloys and silica and/or alumina could be used to produce refractories in accordance with these patents.

Experimental Results—Explosibility of Powders

To avoid high shipping costs involved in using large amounts of refractory powder, experiments have been done to determine the amount of inert refractory material needed to render finely divided metallic powders either relatively non-explosive or completely non-explosive.

The experiments were done using aluminum metal and a variety of metallic alloys including aluminum-magnesium alloys, magnesium-calcium alloys and a strontium-magnesium-aluminum alloy. The metal or alloy powder was premixed with different proportions of burnt magnesite (MgO) as indicated in Table 1 below. The table sets out the proportion of powders and magnesite by weight. Three sizes of magnesite particles were used, firstly a coarse size of less than 65 mesh (200 microns), secondly a fine size of less than 100 mesh (150 microns), and thirdly a finer size with 43% less than 200 mesh (74 microns). A considerable proportion, for example about 30 to 40% of the magnesite particles were greater than 200 mesh. Explosion tests were carried out to determine the Minimum Explosible Concentration (MEC) and in some cases Minimum Oxygen Concentration (MOC) for the various mixtures. The MEC is the least amount of the dust dispersed homogeneously in air which can result in a propagating explosion. Lesser quantities may burn momentarily after being exposed to an ignition source, but no explosion will result. An alternative means of prevention of explosions is to use an inert gas, such as nitrogen, in the space occupied by the dust cloud. To determine the quantity of inert gas required, the MOC was measured for four of the alloy/burnt magnesite samples.

The explosion tests were carried out in a 20-L vessel designed by the U.S. Bureau of Mines with minor modifications. The consensus by experts in dust explosions is that 20-L is the minimum size of vessel that can be used to determine the explosibility of dusts. Dust explosion experts also concur that a strong igniter, such as the 5-kJ Sobbe chemical igniter, is required for the determination of the MEC. Use of a continuous electrical discharge, as was formerly used, can indicate that a dust is not explosible when indeed it is. All the explosion tests used for the determination of the MEC in these experiments used the 5-kJ Sobbe igniter.

For each test, a weighed amount of dust was placed into the sample holder at the base of the vessel, the igniter was placed in the centre of the vessel, the vessel was closed and then evacuated. A 16-L pressure vessel was filled with dry air at 1100 kPa and the trigger on the control panel was pressed to start the test. A solenoid valve located between the 16-L vessel and the dust chamber opened for a preset time, usually about 350 ms, which allowed the air to entrain the dust and form a reasonably homogeneous dust cloud in the 20-L vessel at a pressure of one atmosphere absolute. After another preset time, usually about 100 ms, the igniter fired. The entire pressure history of the test was captured on a Nicolet™ 4094 digital oscilloscope. After the combustion gases had cooled, they were passed through a Taylor Servomex™ paramagnetic oxygen analyzer, from which the percentage of oxygen consumed was calculated. A fine-gauge thermocouple is installed inside the vessel, and its output was also recorded by the oscilloscope. Although a thermocouple cannot be expected to measure the actual temperature of the flame front during the explosion, it provides useful confirmation of the existence of the explosion.

The Sobbe igniter itself generates a significant pressure (about 50 kPa for the 5-kJ igniter). This was taken into account by subtracting the pressure curve of the igniter from the experimental pressure trace. The rate of pressure rise $(dP/dt)_m$, was determined from the derivative curve, generated numerically by the oscilloscope.

For the MOC determinations, a mixture of dry nitrogen and dry air was prepared in the 16-L air tank, using partial pressures. The actual concentration of these mixtures was measured by flowing a small amount through the oxygen analyzer. The measured value was always close to the calculated value.

Table 1 below sets out the results obtained, for various proportions of inert refractory MgO powder (given in terms of percentages by weight of alloy and MgO), for fine (−100 mesh) and coarse (−65 mesh) refractory. Both for MEC and MOC, the higher numbers indicate a low explosibility of the mixture.

TABLE 1

| Description of Dust | | | | | | |
|---|---|---|---|---|---|---|
| Metallic | % in Mixture | Size (mesh) | % Inert* in Mixture | Size (mesh) | MEC ($gm/m^3$) | MOC (% $O_2$) |
| 50% Al—50% Mg | 100 | 30%, −100 | 0 | — | 90 ± 15 | 8.9 ± 0.3 |
| 50% Al—50% Mg | 100 | 82%, −100 | 0 | — | 52 ± 4 | 7.3 ± 0.2 |
| 50% Al—50% Mg | 60 | 82%, −100 | 40 | 82%, −100 | 110 ± 10 | — |
| 50% Al—50% Mg | 50 | 82%, −100 | 50 | 82%, −100 | 130 ± 10 | 12.4 ± 0.2 |
| 50% Al—50% Mg | 40 | 82%, −100 | 60 | 82%, −100 | 1000 ± 100 | — |
| 50% Al—50% Mg | 35 | 82%, −100 | 65 | 82%, −100 | 1750 ± 250 | — |
| 50% Al—50% Mg | 30 | 82%, −100 | 70 | 82%, −100 | 1600 ± 200 | 17.8 ± 0.2 |
| 50% Al—50% Mg | 25 | 82%, −100 | 75 | 82%, −100 | nonexplosive | — |
| 50% Al—50% Mg | 25 | 82%, −100 | 75 | 97%, −65 + 100 | 1500 ± 50 | — |
| 45% Sr—25% Mg—35% Al | 100 | 20%, −100 | 0 | — | 120 | — |
| 70% Mg—30% Ca | 30 | 82%, −100 | 70 | 82%, −100 | 1700 ± 100 | — |
| 70% Mg—30% Ca | 25 | 82%, −100 | 75 | 82%, −100 | nonexplosive | — |
| 100% Al | 40 | 88%, −325 | 60 | 43%, −200 | 540 ± 14 | — |
| 100% Al | 35 | 88%, −325 | 65 | 43%, −200 | 875 ± 35 | — |

*burnt magnesite (MgO)

The explosivity data in Table 1 relating to the 50% Al—50% Mg metallic powders blended with varying amounts of burnt magnesite are shown in FIG. 1 and indicate the following:

1) The MEC for pure, unblended metallic powders decreases with increasing fineness of powder. For example, a coarse 50% Al—50% Mg powder containing 30%, −100 mesh (150 microns) is explosive if the dust cloud contains at least 90 ± 15 $gm/m^3$. Increasing the fineness of the powder to 82%, −100 mesh substantially increases explosivity with a dust cloud containing only 52 ± 4 $gm/m^3$ now being explosive. Because of safety concerns, many refractory producers sacrifice refractory performance properties by utilizing coarser metallic powders similar mixture made up with 75% coarse magnesite (97%; −65 + 100 mesh) will explode provided the dust cloud contains 1,500 ± 50 $gm/m^3$ or more. However, a mixture in which say 70% of the total mix is less than 65 mesh can be considered relatively non-explosive compared to unblended coarse metallic particles.

5) For the three alloy systems tested, Al—Mg, Mg—Ca and Al metal, it appears the relationship between explosivity and percentage inert in the mixture is similar.

The results for MEC can also be presented in terms of Relative Explosibility, i.e. explosivity as compared to an unblended coarse (50% AL-5% Mg) powder containing 30%–100 mesh, having MEC of 90. The results are shown in Table 2 below;

TABLE 2

| Blend | | |
|---|---|---|
| Fine Alloy Powder | Magnesite | Relative Explosivity* |
| 100% | 0 | 1.73 |
| 60% | 40% | 0.82 |
| 50% | 50% | 0.69 |
| 40% | 60% | 0.09 |
| 35% | 65% | 0.051 |
| 30% | 70% | 0.056 |
| 25% | 75% | nonexplosive |

*compared to unblended coarse alloy powder

Figure 2:
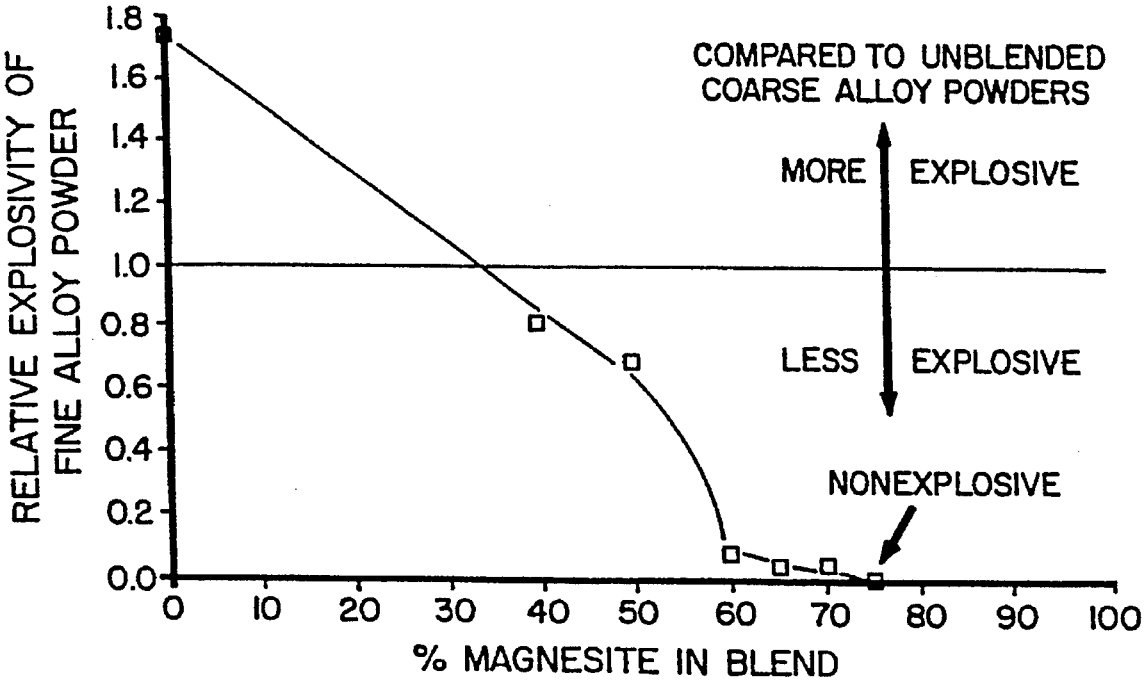
FIG. 2 is a graph showing relative explosivity of the premixture, compared to an unblended coarse alloy powder, plotted against percentage magnesite in the premixture.

Table 2 and FIG. 2 shows that:

1) pure unblended fine alloy powder is 1.73 times more explosive than the pure unblended coarse alloy (a MEC of 52 compared to 90);

2) fine alloy powder blended with about 35% magnesite has a Relative Explosivity equal to 1. This indicates that the explosivity of the fine alloy powder has been reduced by blending with 35% magnesite to a value equivalent to pure unblended coarse alloy powder;

3) by increasing the proportion of magnesite in the blend, the fine alloy powder becomes progressively more inert compared to unblended coarse alloy powder. With 60% magnesite, the mixture is highly inert and at 75% magnesite it is non-explosive.

The above experimental data illustrate the important relationships which must be considered when setting out to reduce the explosiveness of a metallic powder by blending with an inert material. A proper blend can be safely handled, packaged, shipped and stored with a substantially lower risk of explosion than pure metallic powder.

The examples below illustrate a process for producing fine metallic powders with reduced risk of explosion by simultaneously and progressively reducing the size of a blend of metallics and inert material in a suitable milling device such as a ball mill, rod mill, hammer mill, hogging mill and the like.

EXAMPLE 1

A rotating ball mill containing 1,683 kg of balls was charged with a 500 kg mixture containing 75% by weight –2000 microns burnt magnesite and 25% by weight –13 mm (½ inch) 50% Al–50% Mg alloy. Prior to charging to the ball mill, the alloy had been prepared by simultaneous melting of magnesium and aluminum metals in the desired proportions in a suitably designed melt pot. The molten alloy was cast as ingots and subsequently crushed to –13 mm in a jaw crusher.

This mixture of magnesite and metallics was simultaneously ground in the mill for 1 hour. A sample of the inert material, metallic powder mixture was taken from the mill yielding a blended product of 64% –100 mesh. An analysis of the mixture showed the metallic portion was 72%, –100 mesh with an average particle size of 111.4 microns. The burnt magnesite fraction was 62%, –100 mesh having an average particle size of 136.0 microns.

EXAMPLE 2

The material in example 1 was further ball milled for an additional hour (total 2 hours) and sampled. The mixture was now finer measuring 85%, –100 mesh with the metallic portion being 90%, –100 mesh and the magnesite 83%, –100 mesh. Average metallic and magnesite particle sizes were 74.8 microns and 84.9 microns, respectively.

EXAMPLE 3

The material in example 2 was further ball milled for an additional hour (total 3 hours) and sampled. After 3 hours, the blend was 91%, –100 mesh with the metallic portion being 93%, –100 mesh and the magnesite being 90%, –100 mesh. The average particle size was 71.0 microns for the metallic fraction and 74.9 microns for the magnesite.

EXAMPLE 4

A 400 kg mixture containing 75% by weight fine magnesite (55%, –43 microns) and 25% by weight -13 mm crushed 50% A1-50% Mg alloy was charged to a ball mill containing 983 kg of balls. After 1 hour and 15 minutes of grinding, the blended material inside the mill was sampled. The blend was 92%, –100 mesh with the metallic portion being only 82%, –100 mesh and the magnesite being 96%, –100 mesh. The average particle size in the blend was 99.6 microns for the metallic powder and 68.2 microns for the inert material.

EXAMPLE 5

The material in example 4 was ground for an additional 30 minutes (1 hour and 45 minutes total) and sampled. The blend was 95%, –100 mesh with the metallic fraction being 91%, –100 mesh and the magnesite 96%, –100 mesh. The average metallic and magnesite particle sizes were 85.7 microns and 69.5 microns respectively.

EXAMPLE 6

Approximately 375 kg of coarse magnesite briquettes –25.4 mm was charged to a ball mill containing 750 kg of balls. After 15 minutes of grinding, the magnesite was reduced in size with 23%, –100 mesh. A further 15 minutes increased the –100 mesh portion to 55%. At this point, 125 kg of precrushed 50% Al-50% Mg alloy was charged to the mill and the mixture was ground simultaneously. The following screen size distribution was obtained at various grinding times:

| Grinding Time Min. | Screen Size of Blend % –100 mesh |
|---|---|
| 30 | 68% |
| 60 | 79% |
| 90 | 87% |

A second similar test produced 90% of the mixture being –100 mesh after a similar grinding time.

EXAMPLE 7

A rotary ball mill containing 112 kg of steel balls was charged with 75 kg of burnt magnesite briquettes. After 15 minutes of grinding, the MgO had been reduced to 85%, –100 mesh. Subsequently 25 kg of aluminum metal granules (100%, –20 mesh; 96.5%, +100 mesh) was charged to the ball mill. The screen size of the mixture of Al metal granules and premilled MgO in the ball mill was 14%, 35 mesh with 65%, –100 mesh. The mixture was then ball milled for 105 minutes yielding a product with 3%, +35 mesh and 79%, –100 mesh.

Figure 3:
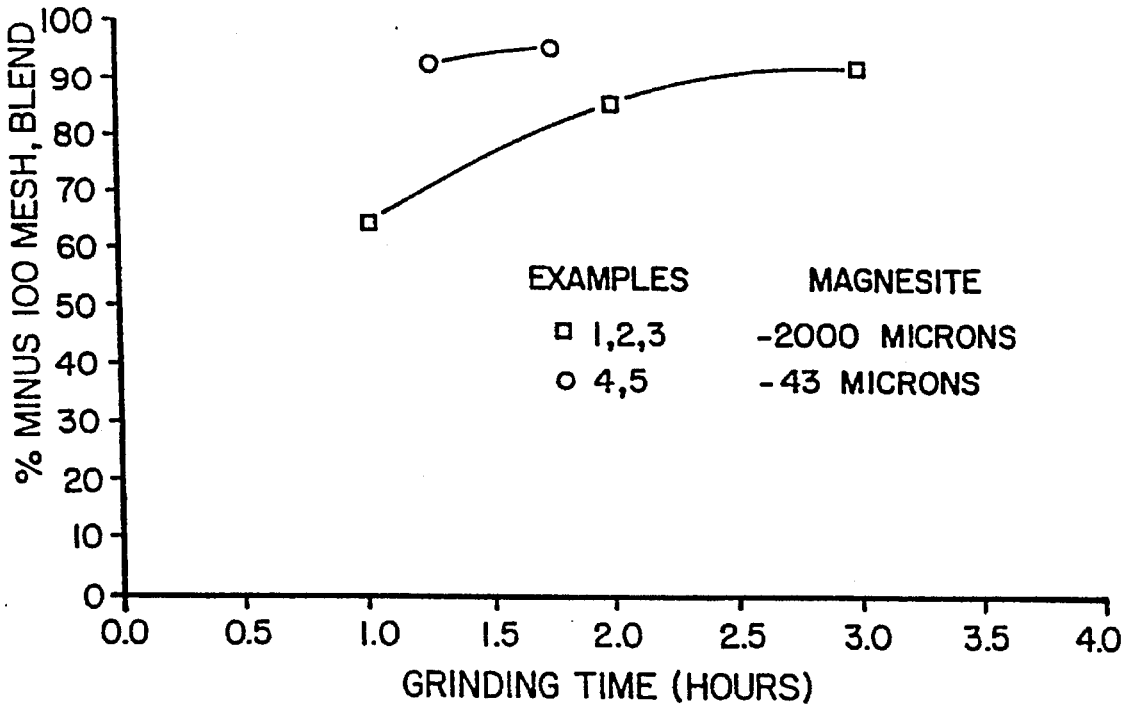
FIG. 3 is a graph showing how the fineness achieved for the premixture particles varies with grinding time.

FIG. 3 illustrates that the –100 mesh proportion of the blend can be increased by lengthening the grinding time. Conversely, grinding time can be shortened by introducing finer inert material into the mill.

Figure 4:
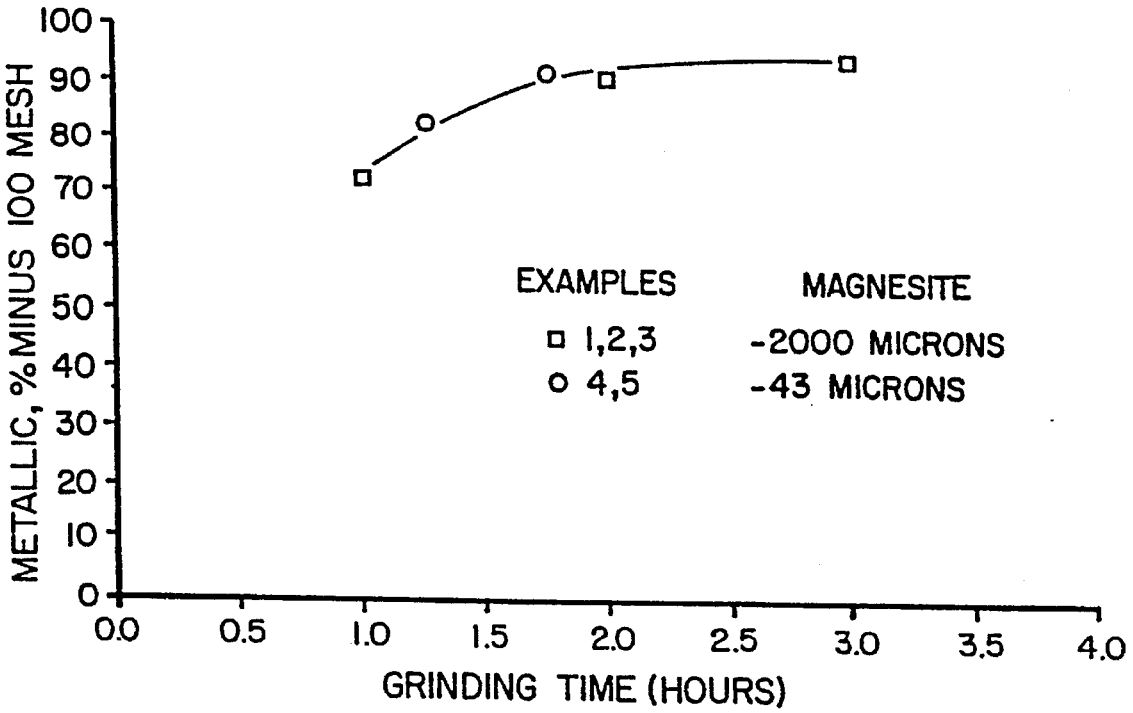
FIG. 4 is a graph showing how the fineness achieved for the metallic particles varies with grinding time.

FIG. 4 illustrates that the –100 mesh proportion of the metallic portion of the blend also increases with grinding time. The resulting fineness of the metallics appears relatively unaffected by the initial fineness of the burnt magnesite charged to the mill.

These examples illustrate how the final screen size distribution of both the inert and metallic fractions can be influenced by mill operating parameters such as:

*screen size of the respective charge materials to the mill

*weight of the grinding media

*grinding time

By controlling these operating parameters, it is possible to produce a blended product which is both substantially non-explosive and satisfies the screen size distribution for the materials of refractory manufacture.

We claim:

1. A mixed powder suitable for use in making refractories after addition of refractory powder and binder thereto, said mixed powder being free of binder and consisting essentially of:

finely divided particles of metal selected from the group consisting of aluminum, magnesium, or alloys of aluminum, magnesium or calcium, said metal particles forming at least 20% of the mixed powder and including 80% of particles less than 100 mesh; and finely divided inert refractory material which comprises from 40% to 80% of the total mixed powder, at least 50% of said refractory material being less than 65 mesh while at least 25% of the refractory material is greater than 200 mesh; and wherein the refractory particles are present in such particle sizes and quantities as ensure that the Minimum Explosible Concentration, as tested in a 20-L vessel with a chemical igniter, is greater than 100 gm/m$^3$.

2. A mixed powder according to claim 1, wherein the refractory particles are present in such particle sizes and quantities that the Minimum Explosible Concentration, as tested in a 20-L vessel with a chemical igniter, is greater than 200 gm/m$^3$.

3. A mixed powder according to claim 1, wherein the inert refractory material constitutes 50% to 80% of the total mixed powder.

4. A mixed powder according to claim 1, wherein said inert refractory material includes particles of less than 65 mesh which comprise at least 75% of the total mixed powder.

5. A mixed powder according to claim 1, wherein said inert refractory material has particles at least 50% of which are less than 100 mesh.

6. A mixed powder according to claim 1, wherein said inert refractory material is selected from the group consisting of magnesia, alumina and silica.

7. A mixed powder according to claim 1, wherein at least 80% of said refractory particles are less than 100 mesh, and constitute at least 60% of the total mixed powder.

8. A mixed powder according to claim 1, wherein said inert refractory material includes calcined dolomite.

9. A mixed powder according to claim 1, in dry and readily flowable form.

10. A mixed powder according to claim 1, wherein at least 30% of the refractory is greater than 200 mesh.

11. A mixed powder according to claim 1, wherein the particles of metal are alloys of aluminum, magnesium or calcium.

* * * * *